US007121026B2

(12) United States Patent
Chen

(10) Patent No.: US 7,121,026 B2
(45) Date of Patent: Oct. 17, 2006

(54) ADVERTISEMENT BILLBOARD

(76) Inventor: Hua-Ping Chen, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 10/366,622

(22) Filed: Feb. 14, 2003

(65) Prior Publication Data

US 2004/0159025 A1 Aug. 19, 2004

(51) Int. Cl.
*G09F 11/02* (2006.01)

(52) U.S. Cl. ..... 40/504; 40/505; 40/506

(58) Field of Classification Search ..... 40/503, 40/504, 505, 506
See application file for complete search history.

(56) References Cited

U.S. PATENT DOCUMENTS 969,780 A * 9/1910 Gee ..... 40/505
1,195,369 A * 8/1916 La Pearl ..... 40/475
1,362,542 A * 12/1920 Rogers ..... 40/505
1,389,078 A * 8/1921 Spinello ..... 40/505
4,274,218 A * 6/1981 Harvey ..... 40/505
6,065,232 A * 5/2000 Haughey et al. ..... 40/503

* cited by examiner

*Primary Examiner*—Gary C. Hoge
(74) *Attorney, Agent, or Firm*—Troxell Law Office PLLC

(57) ABSTRACT

The advertisement billboard includes at least one rotatable polyhedral column and a driving mechanism provided on a frame. The polyhedral column is consisted of a plurality of rotatable exhibiting boards having an obverse side and a reverse side. Each obverse side of the exhibiting boards outwardly displays an advertisement in sequence when the polyhedral column rotates for the first revolution, and each reverse side of the exhibiting boards outwardly displays an advertisement when the polyhedral column rotates for the second revolution, thereby enabling the advertisement billboard to display a multiple of planar advertisements.

6 Claims, 10 Drawing Sheets

ADVERTISEMENT BILLBOARD

BACKGROUND OF THE INVENTION (a) Field of the Invention

The invention relates to an advertisement billboard, and more particularly, to an advertisement billboard capable of exhibiting a multiple of planar advertisement and automatically exchanging displays using impulse from a driving mechanism thereof.

(b) Description of the Prior Art

Advertisement billboards are for exhibiting planar advertisements of certain corporations or products in order to impress consumers with images of these corporations or products, thereby increasing subsequent purchase demands and business opportunities thereof.

Referring to FIG. 1 showing a conventional elevational view of a prior advertisement billboard consisted of at least a piece of long-stripped 180-degree rotatable exhibiting board 1 (FIG. 1 shows a plurality of long-stripped exhibiting boards vertically or horizontally arranged in order for constructing a large planar advertisement); the exhibiting board 1 has two exhibiting planes namely an obverse side and a reverse side, and has a driving mechanism 2 at the two ends thereof, respectively. When the driving mechanism 2 impels and rotates the exhibiting board 1, the exhibiting board 1 originally with the obverse side thereof facing outward then has the reverse side thereof face outward instead, thereby achieving the purpose of exchanging the advertisements on the obverse and reverse sides for display.

Referring to FIG. 2 showing an advertisement billboard structure capable of exchanging three planar advertisements, the structure comprises at least one trihedral column 3 whose three outer planes serve as exhibiting planes (FIG. 3 shows a plurality of trihedral columns 3 vertically or horizontally arranged in order). At the two ends of the trihedral columns 3 are respectively provided with a driving mechanism 2 that rotates 120 degrees at a time so as to exchange the three exhibiting planes, thereby accomplishing the object of increasing spaces available for advertisements.

Although the aforesaid prior advertisement billboards capable of exchanging two or three advertisements indeed increase spaces available for advertisements, the spaces for advertisements yet appear rather insufficient in occasions where crowds gather.

SUMMARY OF THE INVENTION

Therefore, the object of the invention is to provide an advertisement billboard capable of exchanging even more advertisements, so that predicaments such as having inadequate spaces in so-called "golden miles" are avoided.

The advertisement billboard in accordance with the invention comprises at least one rotatable polyhedral column and a driving mechanism, wherein each plane of the polyhedral column is a piece of long-stripped exhibiting board having an obverse and a reverse side. In one revolution of the polyhedral column, each obverse side of the long-stripped exhibiting boards outwardly displays an advertisement in sequence, and automatically turns over after passing through the front of the advertisement billboard, so that during the second revolution of the polyhedral column, each reverse side of the long-stripped exhibiting boards faces outward, thereby enabling the advertisement to display a multiple of planar advertisements as well as saving spaces.

In an embodiment according to the invention, the aforesaid polyhedral column may be replaced by a trihedral column consisted of three long-stripped exhibiting boards. When the trihedral column is impelled and rotated by the driving mechanism, at least six planar advertisements may be displayed for that each of the three rotatable long-stripped exhibiting boards has an obverse and a reverse side. Similarly, eight planar advertisements may be displayed using a polyhedral column consisted of four long-stripped exhibiting boards.

In addition, larger planar advertisements may be constructed by arranging a plurality of the aforesaid polyhedral columns for exchangeable displays on both sides thereof.

DETAILED DESCRIPTION OF THE PREFERRED EMBODIMENTS

To better understand the technical characteristics of the invention, descriptions shall be given with the accompanying drawings hereunder.

Figure 1:
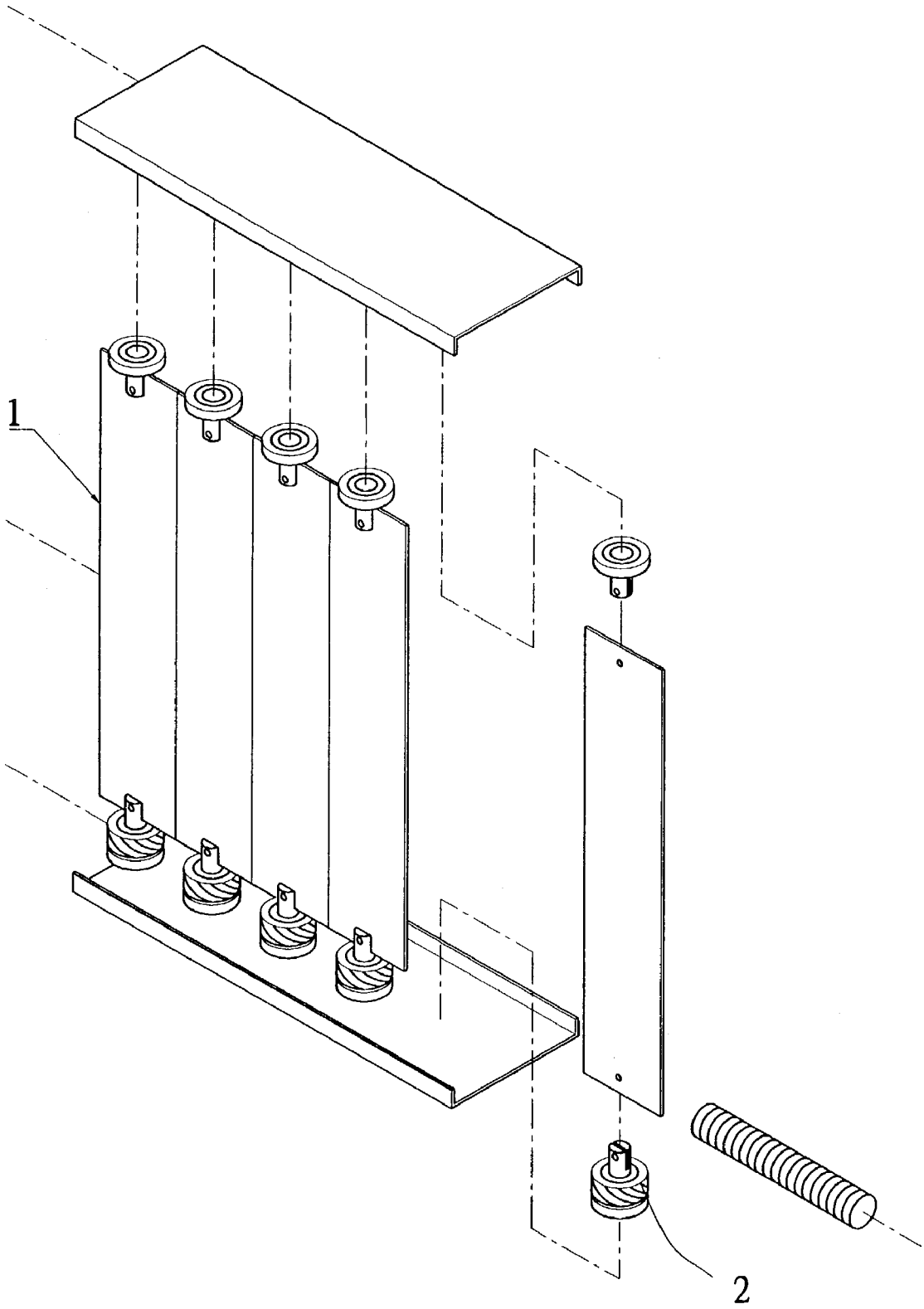
PRIOR ART Fig 1
FIG. 1 shows a conventional elevational view of a prior advertisement billboard capable of exchanging two advertisements.
Figure 2:
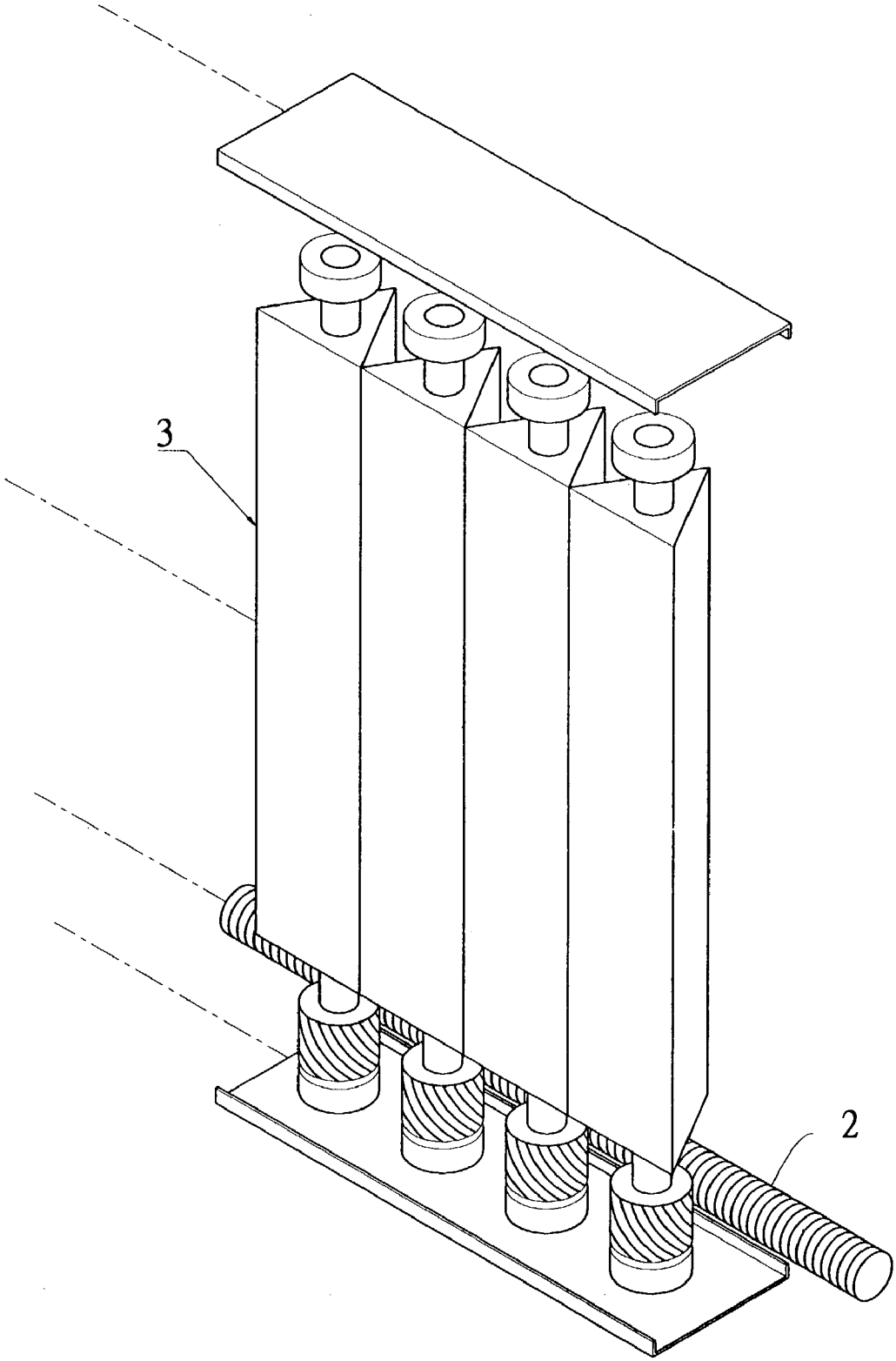
PRIOR ART Fig 2
FIG. 2 shows a conventional elevational view of a prior advertisement billboard capable of exchanging three advertisements.
Figure 3:
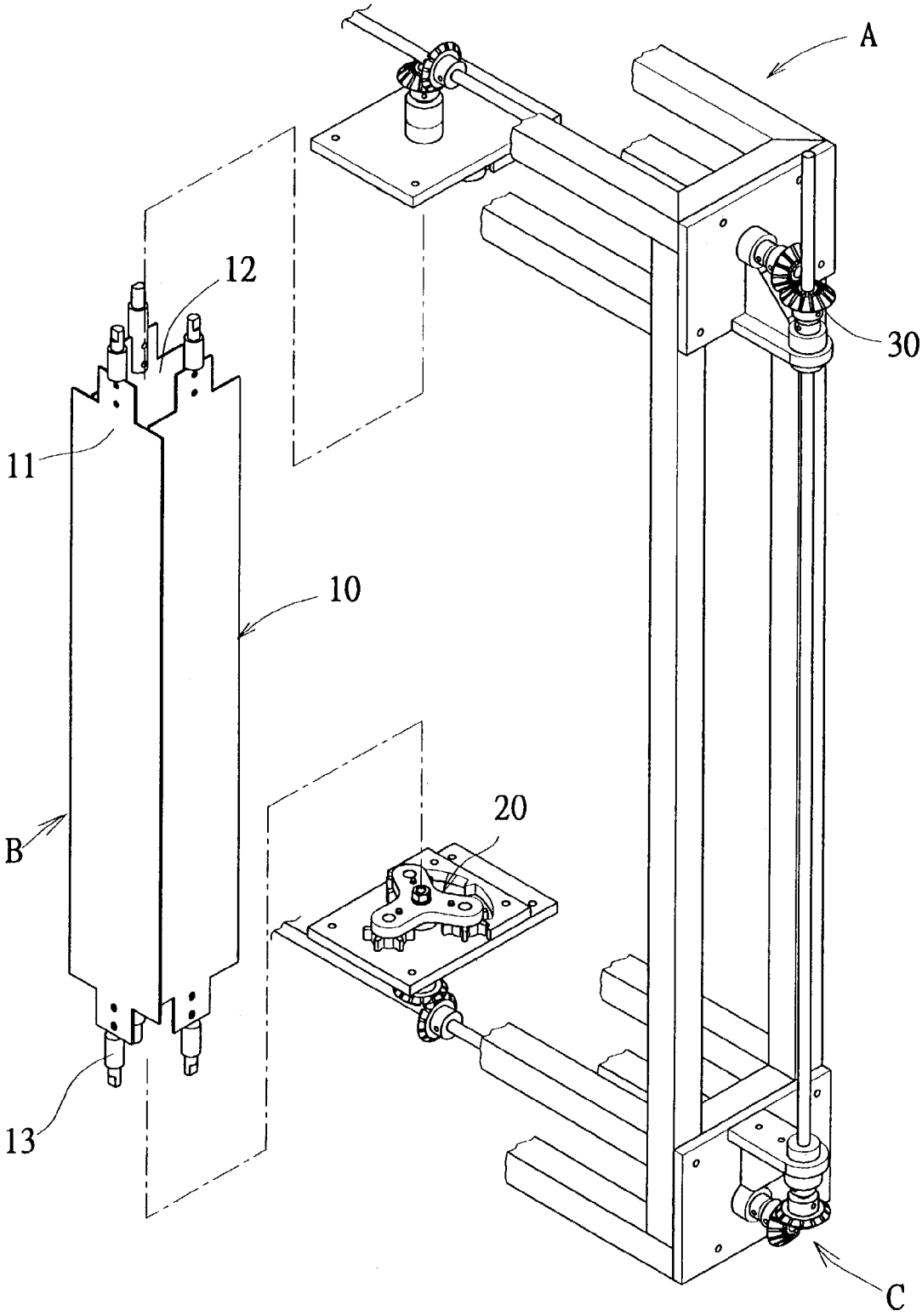
FIG. 3 shows an exploded elevational view in accordance with the invention.

Referring to FIG. 3, the advertisement billboard in accordance with the invention comprises at least one rotatable polyhedral column B and a driving mechanism C both disposed on a frame B, wherein the polyhedral column B is consisted of a plurality of long-stripped exhibiting boards 10. When the polyhedral column B rotates, each long-stripped exhibiting board 10 circles around at the periphery of the polyhedral column B. Each long-stripped exhibiting board 10 has an obverse side 11 and a reverse side 12, and is provided with a spindle 13 at the upper and lower ends thereof, respectively, so as to have each long-stripped exhibiting board 10 rotate by facing one another and exchange the obverse and reverse sides 11 and 12.

In the diagram, the polyhedral column B is a trihedral column consisted of three long-stripped exhibiting board 10. As the aforesaid description, each long-stripped exhibiting board 10 has on obverse and a reverse side that are rotatable, respectively. Therefore, by disposing one planar advertisement on the obverse and reverse sides of the long-stripped exhibiting board 10, respectively, and with the aid of the driving mechanism C, up to six planar advertisements may be displayed at a time.

Figure 4:
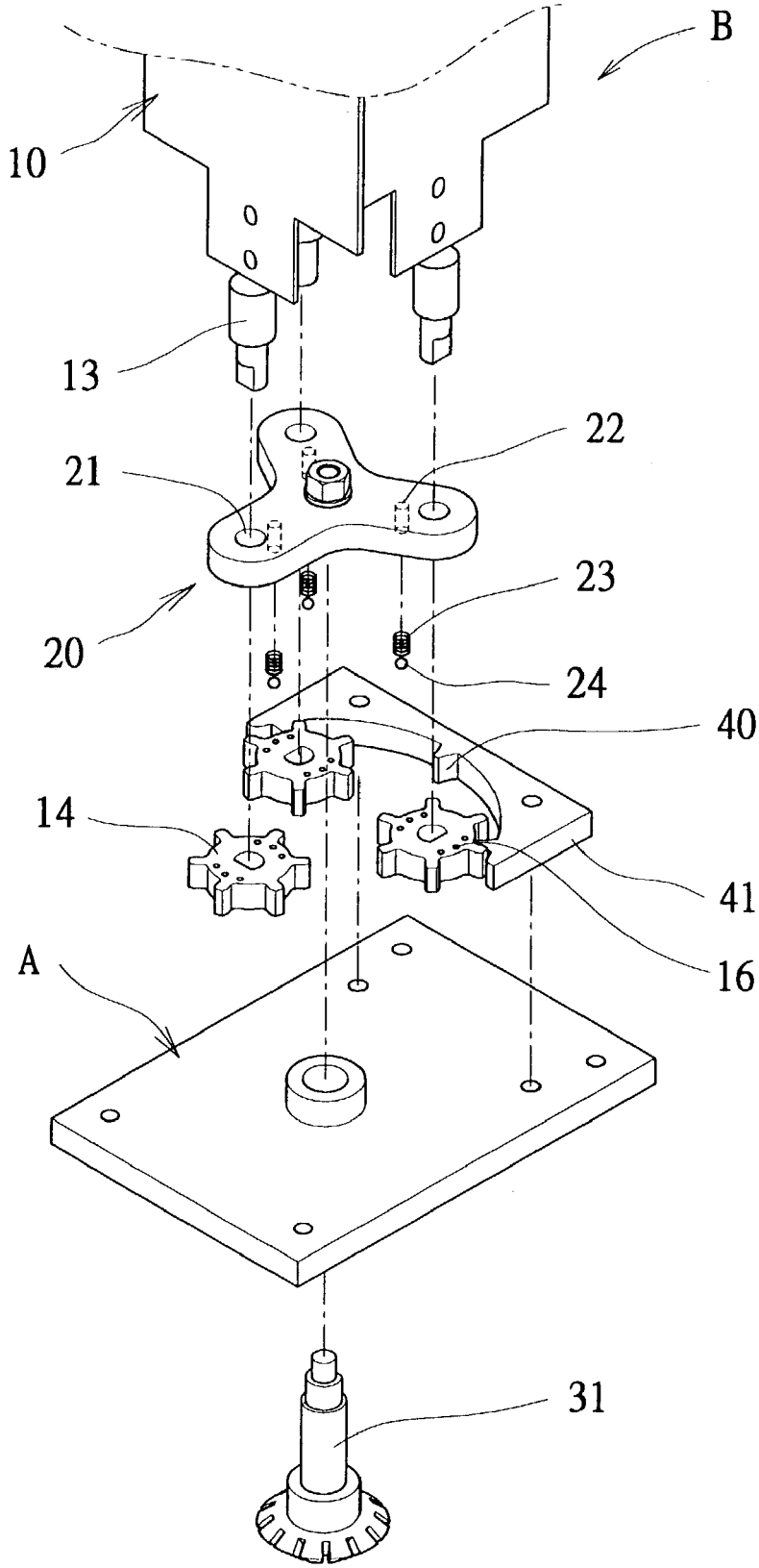
FIG. 4 shows a partial exploded elevational view in accordance with the invention.

Referring to FIGS. 3 and 4, the aforementioned driving mechanism C is consisted of upper and lower turnables 20, a driving wheel assembly 30, and a plurality of retaining flanges 40; wherein the upper and lower turnables 20 are disposed at the upper and lower ends of the polyhedral column, respectively, and at corresponding locations to the spindles 13 of the long-stripped exhibiting board 10 are provided with axis openings 21 for pivotally connecting the spindles 13, such that the long-stripped exhibiting board 10 rotates relative to the upper and lower turnables 20; the long-stripped exhibiting board 10 is further provided with a driven gear 14 at the upper or lower end thereof after the upper or lower spindle 13 is inserted through the corresponding axis opening 21 at the upper and lower turnables 20; the upper and lower turnables 20 are pivotally disposed at the frame A such that the upper and lower turnables 20 rotate relative to the frame A while impelling the polyhedral column B to rotate simultaneously;

the driving wheel assembly 30 is connected to a motor (not shown) and disposed at an appropriate location of the frame A, and is consisted of a plurality of gears and drive shafts; at one of the centers of the upper and lower turnables 20 is combined and disposed with a turnable gear 31 that is impelled and rotated when the motor impels the gears and drive shafts with one of the upper and lower turnable 20 rotated for driving the other turnable as well as rotating the polyhedral column B; and as described before, each of the long-stripped exhibiting boards 10 circles around at the periphery of the polyhedral column B (refer to FIG. 5), at the meanwhile, the driven gears 14 also circle around the centers of the upper or lower turnable 20; and the plurality of retaining flanges 40 are disposed at the periphery of the upper or lower turnable 20 correspondingly to the driven gears 14, such that the locations of the retaining flanges 40 are exactly at the circumference of the driven gears 14 in circular motions when the driven gears 14 circle of center of the upper or lower turnable 20 resulted from rotation of the upper and lower turnables 20.

Figure 5:
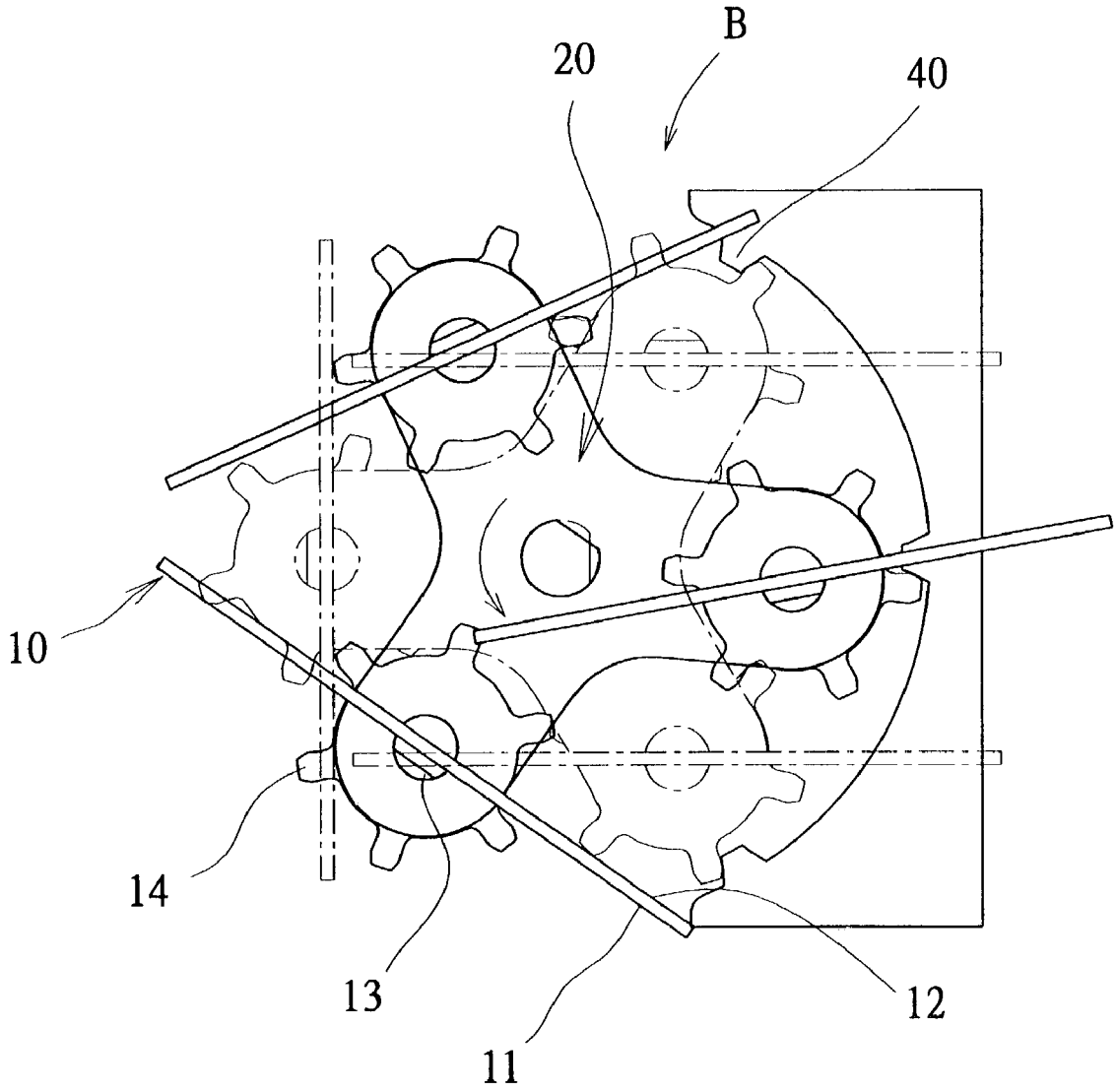
FIG. 5 shows a schematic view illustrating the relationship of the positions of retaining flanges and the exhibiting board in accordance with the invention.
Figure 6:
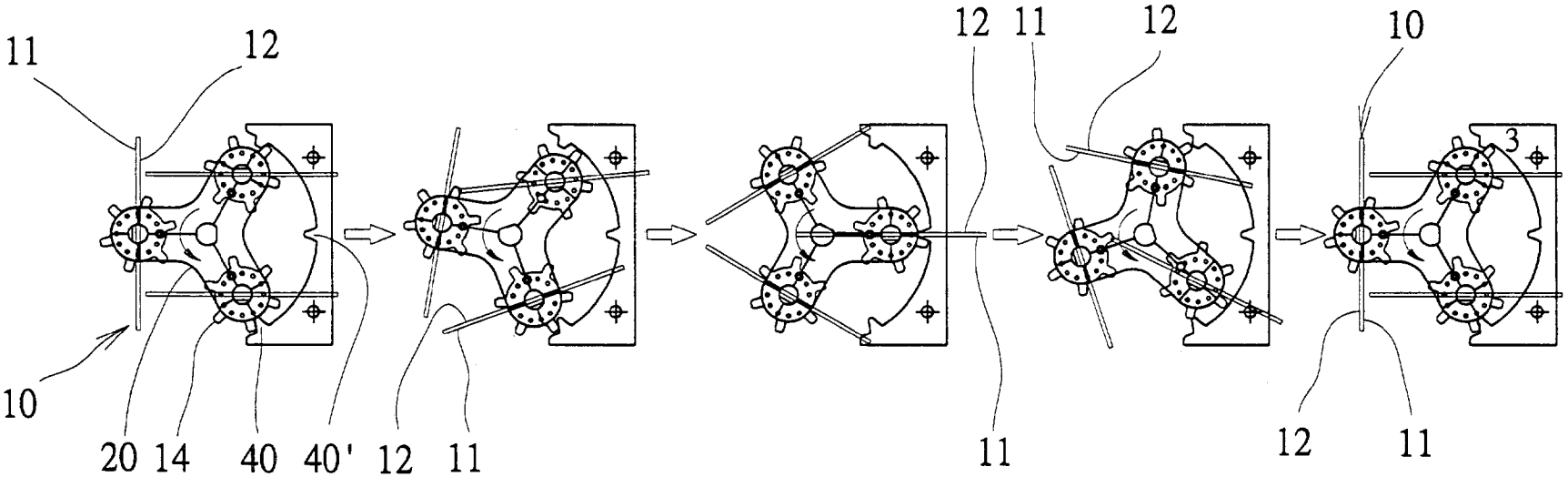
FIG. 6 shows a schematic view illustrating the actions of an exhibiting board and a gear plate in accordance with the invention.

Referring to FIGS. 5 and 6, when the upper and lower tunables 20 rotate and further impel the driven gear 14 for circular motions, the retaining flanges block the traveling path of the driven gear 14. After the driven gear 14 passes through one of the retaining flanges 40, the driven gear 14 deviates an angle relative to the turnables 20 due to the contact with and blocking of the retaining flange 40, and therefore the spindle 13 and the long-stripped exhibiting board 10 combined by the driven gear 14 are also deviated relative to the turnables 20.

To be more exact, when the driving wheel assembly 30 is impelled by the motor, referring to FIGS. 3 and 4, the turnable gear 31 rotates the upper and lower turnables 20 and the polyhedral column B, so as to impel each long-stripped exhibiting board 10 and the driven gear 14 thereof to circle around the centers of the upper and lower turnables 20; and after the driven gear 14 passes through one of the retaining flanges 40, the driven gear 14 along with the combined spindle 13 and the long-stripped exhibiting board 10 thereof deviate an angle relative to the turnables 20.

FIG. 6 discloses a schematic for illustrating a long-stripped exhibiting board 10 rotating one revolution relative to the turnable 20. At the left of the diagram, the obverse side 11 of a long-stripped exhibiting board faces outward for displaying a planar advertisement disposed at the obverse side 11 thereof, and the reverse side 12 thereof faces inward. When the turnables 20 rotate the long-stripped exhibiting board 10 and the driven gear 14 passes through one of the retaining flanges 40, the long-stripped exhibiting board 10 deviates an angle. At this point, the turnables 20 keep on rotating, and the driven gear 14 of the long-stripped exhibiting board 10 passes through other retaining flanges 40' with deviation in sequence and restores back to the original position after making one complete revolution. Referring to the right of the diagram, the long-stripped exhibiting board 10 now has the reverse side 12 thereof face outward for displaying another planar advertisement disposed at the reverse side 12 thereof, and the obverse side 11 thereof faces inward. As it should be, the obverse side 11 shall face outward again if the turnables 20 rotate for the second revolution.

Similarly, the other long-stripped exhibiting boards act the same way. As a result, when the polyhedral column is a trihedral column and the turnables 20 rotate for the first revolution, the obverse sides 11 of the long-stripped exhibiting boards 10 outwardly display three advertisements in sequence; when the turnables 20 rotate for the second revolution, the reverse sides 12 of the long-stripped exhibiting boards 10 outwardly display another three advertisements in sequence. In this fashion, a polyhedral column having three long-stripped exhibiting boards 10 is able to display up to six advertisements in sequence during two revolutions of the turnables 20.

Figure 7:
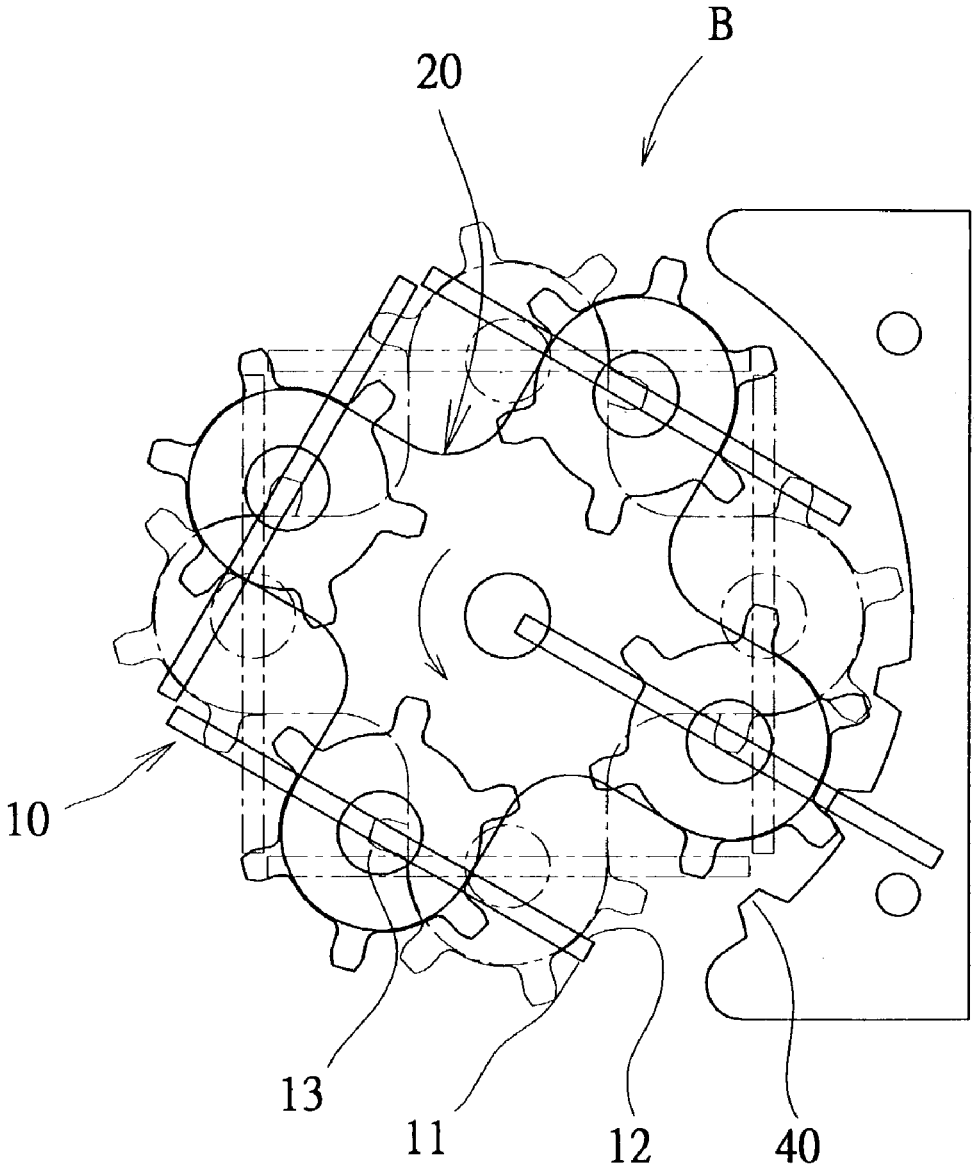
FIG. 7 shows another embodiment of a polyhedral column in accordance with the invention.

Referring to FIG. 7, in an embodiment according to the invention, the polyhedral column B is similarly consisted of four long-stripped exhibiting boards 10 that may display up to eight planar advertisements during two revolutions of the turnables 20.

Figure 8:
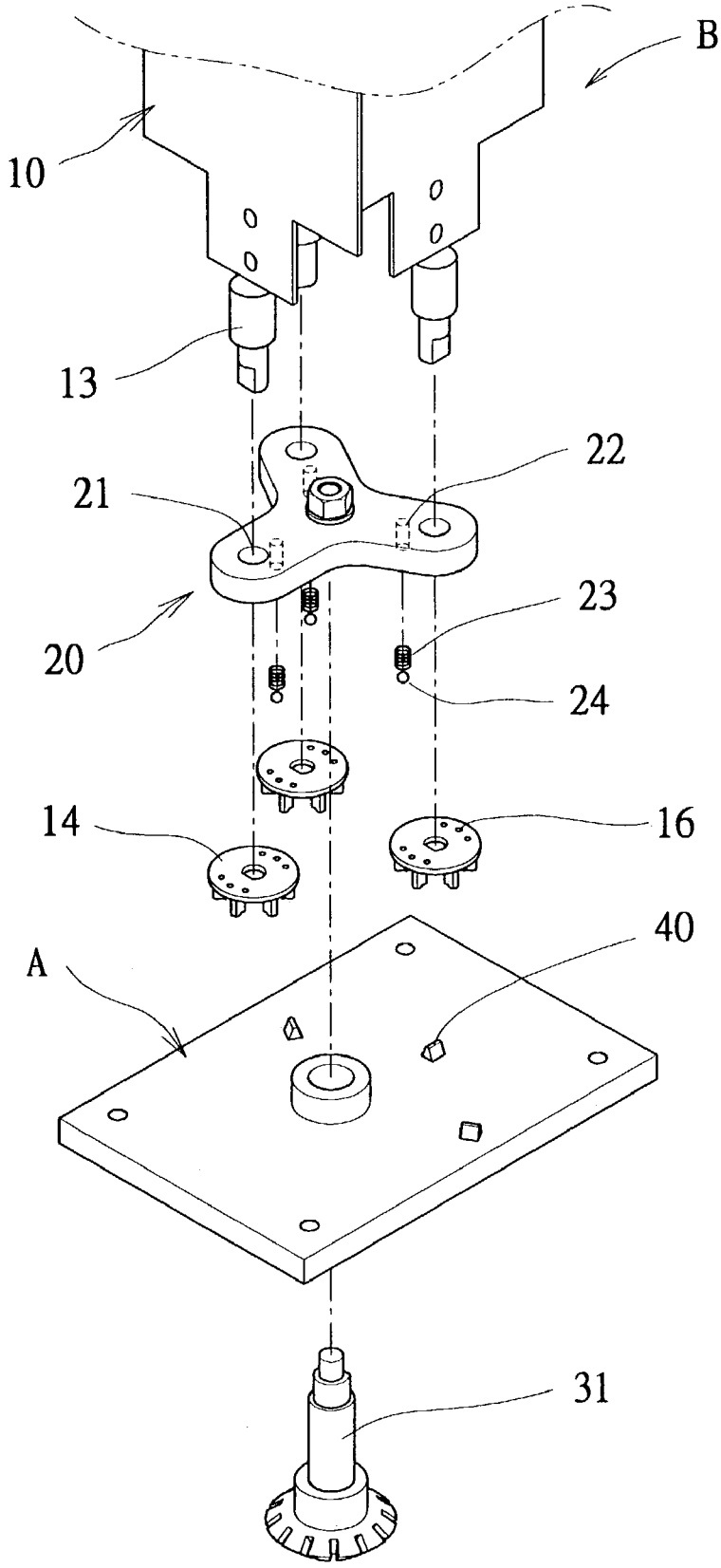
FIG. 8 shows a schematic view of an embodiment illustrating the deviation and positioning of the exhibiting boards and retaining flanges in accordance with the invention.

Referring to FIGS. 4, 6, and 8, in order to have the long-stripped exhibiting board 10 reach a certain location in every deviation thereof during the revolutions of the turnables 20 such that the obverse side 11 or the reverse side 12 thereof is enabled to outwardly display an advertisement at a precise 180-degree location, the turnables 20 are excavated at appropriate locations for providing a plurality of recesses 22 that are further disposed with a spring 23 and a bump 24, respectively, and at corresponding locations of the driven gear 14 of the long-stripped exhibiting board 10 are disposed with positioning holes 16. When the turnables 20 rotate, the bumps 24 are drawn back into the recesses 22 using the springs 23, and hence rotations of the driven gear 14 relative to the turnables 20 is left unaffected. When the turnables 20 rotate to locations where the bumps 24 position with the positioning holes 16, the bumps 24 are fitted into the positioning holes 16 using the springs 23, so that the long-stripped exhibiting board 10 is positioned during the deviation thereof to precisely and outwardly display an advertisement.

Figure 9:
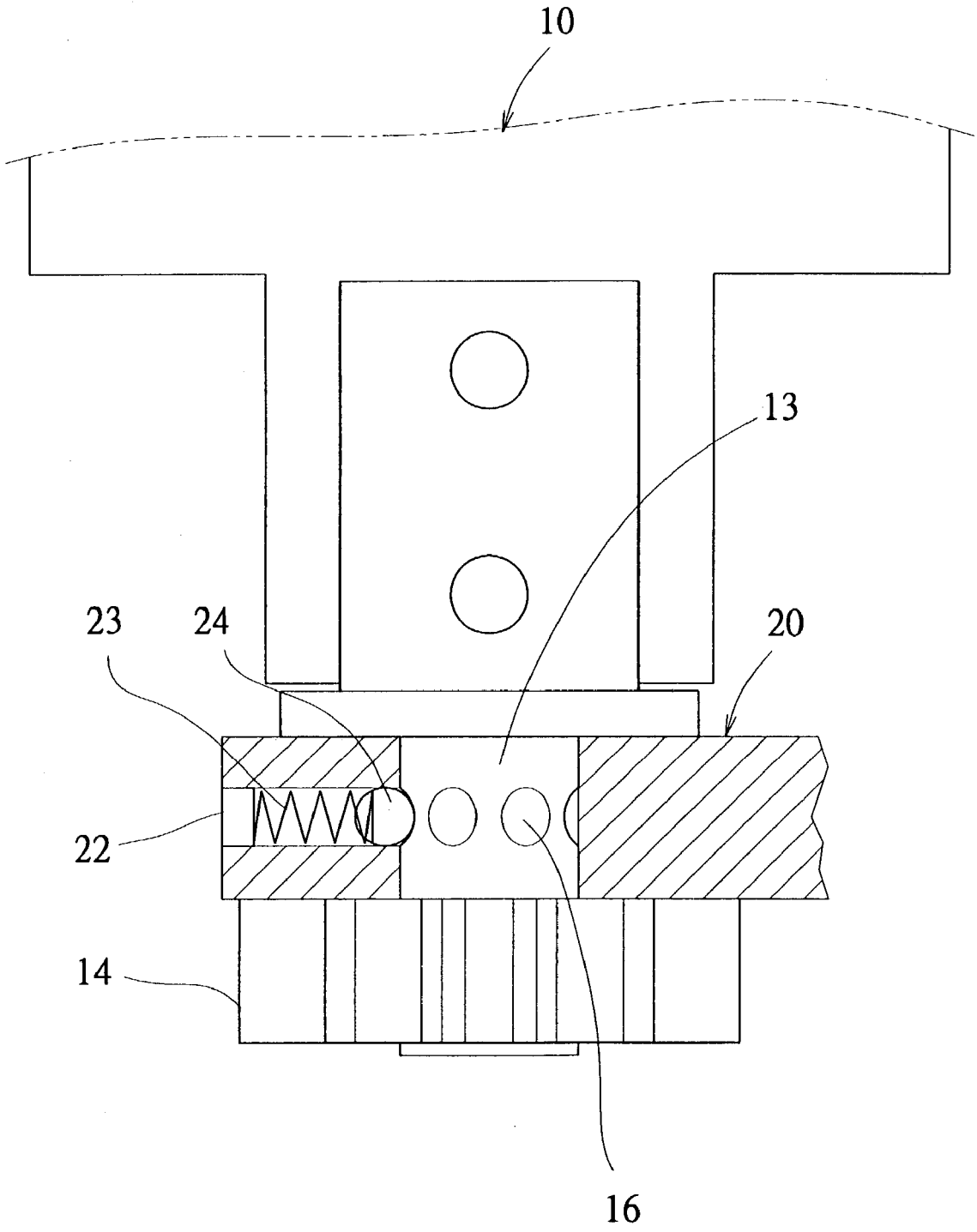
FIG. 9 shows a schematic view of another embodiment illustrating the deviation and positioning of the exhibiting boards in accordance with the invention.

Referring to FIG. 9, the aforesaid recesses 22, springs 23 and bumps 24 may also be disposed at corresponding locations of the turnables 20 and the spindle 13 of the long-stripped exhibiting board 10, and the spindle 13 is further provided with positioning holes 16, thereby positioning the long-stripped exhibiting board 10 during the deviation thereof.

Referring to FIG. 4, the aforesaid plurality of retaining flanges 40 are disposed at the circumference of the upper or lower turnable 20 correspondingly to the driven gear 14. In an embodiment, the retaining flanges 40 may be arranged and disposed on an arcuated board 41 that is provided at the side of the upper or lower turnable 20, so as to have the retaining flanges 40 position at the circumference of the driven gear 14 in circular motions. Also, referring to FIG. 8, the retaining flanges 40 may also be disposed at the frame A; it is of course then the driven gears 14 are provided accordingly to locations of the retaining flanges 40.

Figure 10:
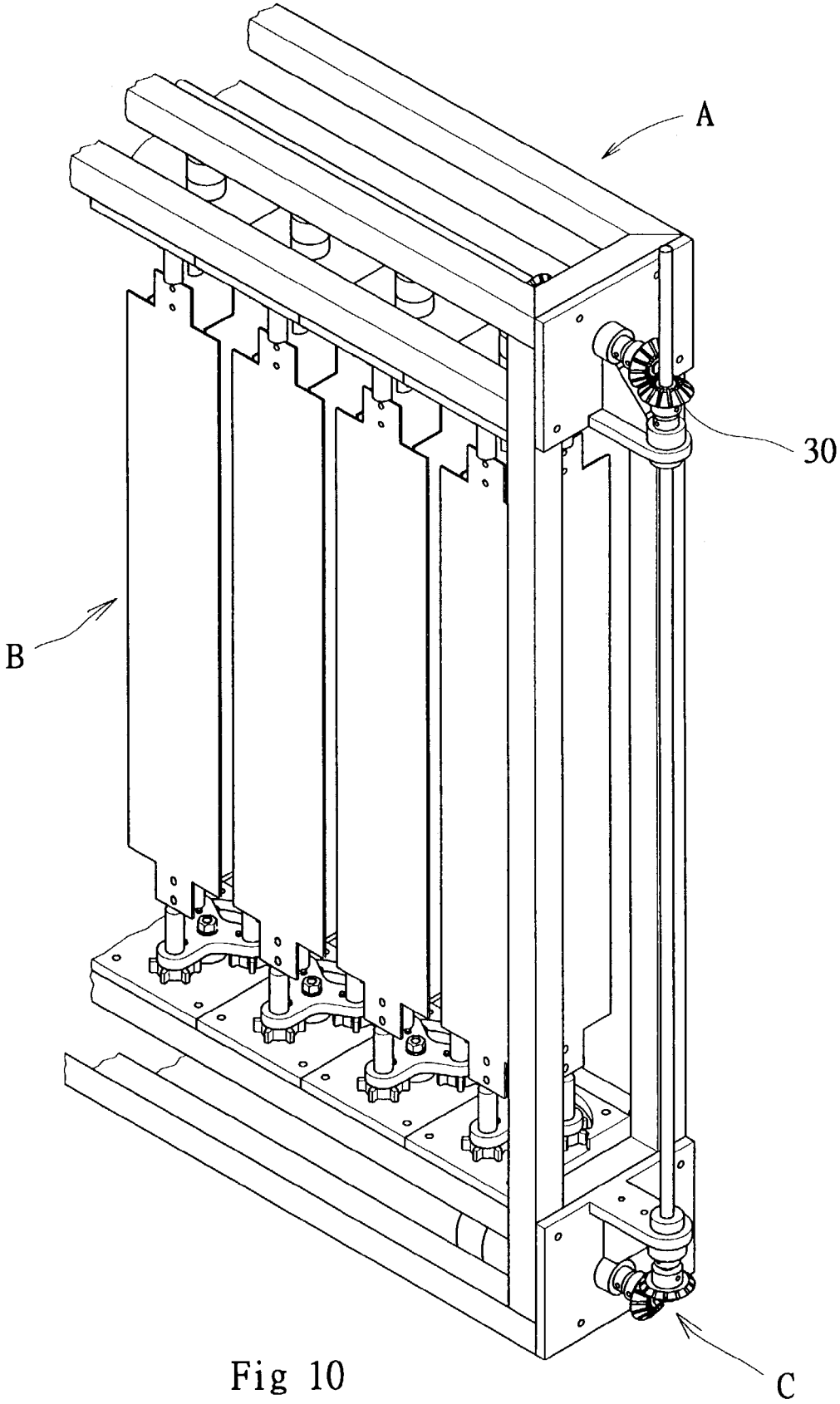
FIG. 10 shows an embodiment of a polyhedral column in accordance with the invention.

Referring to FIG. 10, a plurality of the aforesaid rotatable polyhedral column B may be simultaneously provided and arranged in order for constructing a large advertisement billboard, wherein each of the polyhedral columns B represents a section of the large advertisement, thus forming a larger planar advertisement also capable of exchanging the sides thereof.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. An advertisement billboard comprising: at least one polyhedral column and a driving mechanism provided on a frame; wherein each plane of the polyhedral column is an exhibiting board having an obverse side and a reverse side, and is capable of rotating using a spindle provided at the upper and lower end of the exhibiting board, respectively; each obverse side of the exhibiting board outwardly displays an advertisement in sequence and automatically deviates after the obverse side passes through a front of the advertisement billboard; and each reverse side of the exhibiting boards outwardly displays an advertisement when the polyhedral column rotates for a second revolution, thereby enabling the advertisement billboard to display a multiple of planar advertisements, wherein the driving mechanism further comprising:

upper and lower turnables disposed at the upper and lower ends of the polyhedral column; axis openings provided for pivotally connecting for rotation at corresponding locations to the spindle of the exhibiting board; a driven gear further provided where the spindle is inserted through a corresponding axis opening at the upper and lower turnables having centers thereof pivotally disposed at the frame for rotation;

a driving wheel assembly disposed at the frame and consisted of a plurality of gears and drive shafts, and a turnable gear provided correspondingly at one of the centers of the upper and lower turnables, so as to drive and rotate the turnable gear when the gears and drive shafts are impelled and rotated for further rotating the polyhedral column such that the exhibiting boards and driven gears circle around the center fo the polyhedral column, respectively; and a plurality of retaining flanges disposed at the periphery of the upper or lower turnable correspondingly to the driven gear, such that the locations of the retaining flanges are exactly at the circumference of the driven gear in circular motions when the driven gear circles around the center of the upper or lower turnables resulted from rotation of the upper and lower turnables; and after the driven gear passed through one of the retaining flanges, the driven gear deviates an angle relative to the turnable due to the contact with and blocking of one of the retaining flanges, and further simultaneously deviating the spindle and the exhibiting board relative to the turnable.

2. The advertisement billboard in accordance with claim 1, wherein the polyhedral column is a trihedral column consisting of three exhibiting boards whose obverse and reverse sides display one planar advertisement, respectively, thereby displaying up to six planar advertisements.

3. The advertisement billboard in accordance with claim 1, wherein the polyhedral column is a tetrahedral column consisting of four exhibiting boards whose obverse and reverse sides display one planar advertisement, respectively, thereby displaying up to eight planar advertisements.

4. The advertisement billboard in accordance with claim 1, wherein the turnables are excavated for providing a plurality fo recesses that are further disposed with a spring and a bump, respectively, and at corresponding locations of the driven gear of each exhibiting board are disposed with positioning holes; and when the turnables rotate, the bumps are drawn back into the recesses by the springs, so that each exhibiting board is positioned during the deviation thereof to precisely and outwardly display an advertisement.

5. The advertisement billboard in accordance with claim 1, wherein the retaining flanges are arranged and disposed on an arcuated board that is provided at the side of the upper or lower turnable, so as to have the retaining flanges locate at the circumference of the driven gear in circular motions.

6. The advertisement billboard in accordance with claim 1, wherein the at least one polyhedral column includes a plurality polyhedral columns are simultaneously provided and arranged in order for constructing a large advertisement billboard, and each of the polyhedral columns represents a section of the large advertisement, thus forming a larger planar advertisement also capable of exchanging sides thereof.

* * * * *